United States Patent [19]

Okamura, Sr.

[11] Patent Number: 4,556,993

[45] Date of Patent: Dec. 10, 1985

[54] CONVERTIBLE SUNVISOR CAP

[76] Inventor: Edward T. Okamura, Sr., 2209 Young St., Honolulu, Hi. 96826

[21] Appl. No.: 612,884

[22] Filed: May 22, 1984

[51] Int. Cl.[4] ..... A42B 1/24

[52] U.S. Cl. ..... 2/196; 2/12

[58] Field of Search ..... 2/196, 209.1, 171.5, 2/209.5, 12, 4, 170, 171.1–171.4, 171.6, 171.7

[56] References Cited

U.S. PATENT DOCUMENTS

| | | | |
|---|---|---|---|
| 1,105,400 | 7/1914 | Burke | 2/196 X |
| 1,598,313 | 8/1926 | Rosenberg | 2/196 |
| 1,665,750 | 4/1928 | McKee et al. | 2/12 X |
| 4,277,847 | 7/1981 | Florio | 2/12 |

*Primary Examiner*—Louis K. Rimrodt

*Attorney, Agent, or Firm*—James C. Wray

[57] ABSTRACT

A cap has a releasable rear portion of a crown which is swept forward while the crown is compressed to convert the cap to a sunvisor. A tab connected to the rearward edge of the crown has a fastener at its distal end to connect with a fastener on the visor to convert the cap to a sunvisor.

13 Claims, 7 Drawing Figures

FIG. 1
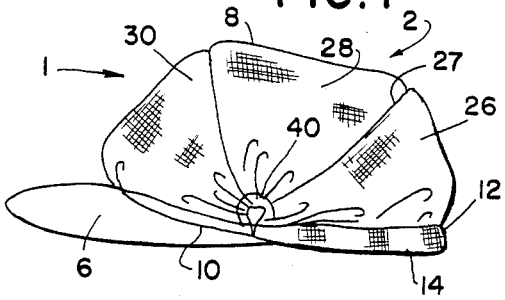
FIG. 4
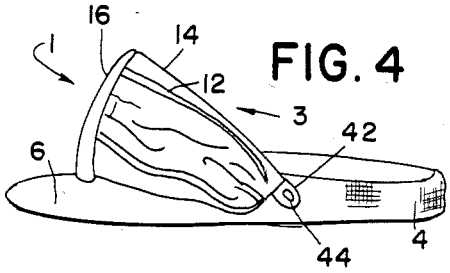
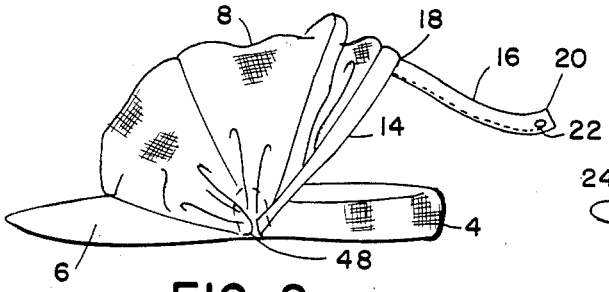
FIG. 2
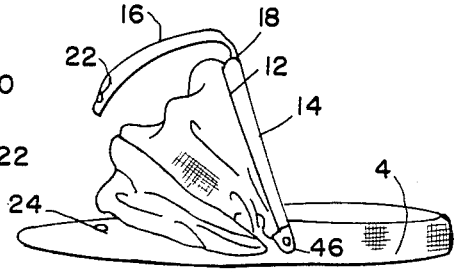
FIG. 3
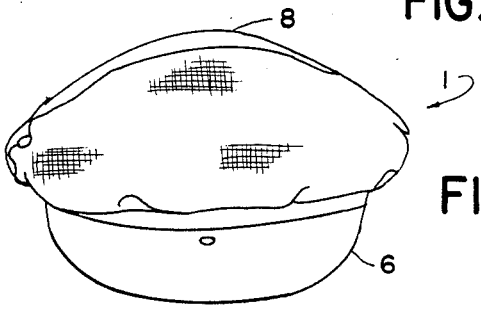
FIG. 5
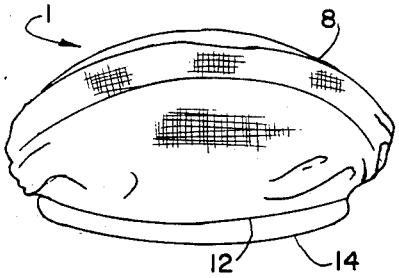
FIG. 6
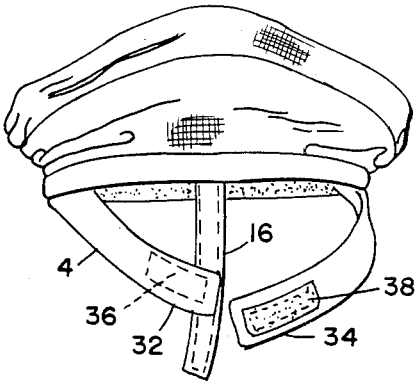
FIG. 7

CONVERTIBLE SUNVISOR CAP

BACKGROUND OF THE INVENTION

Caps, such as baseball caps and golf caps, are well known. Sunvisors to shield the eyes and forehead from the sun while leaving the top of the head exposed are well known and are popular for sports, such as tennis and golf.

Pat. No. 4,023,212 shows a visor having a removable crown. While that cap can be converted to a visor, detachment of the crown is complex, and the crown must be stored separately. When it is desired to return the visor to a cap, operations are complex.

An earlier Pat. No. 748,949, shows a convertible hat with a crown which may be removed entirely.

Pat. No. 2,597,447 shows a cap having a releasable rearward portion. However, the cap is used as a fish landing cap and not a sunvisor. The crown contains a fishnet which would prevent the cap from being used as a sunvisor.

Heretofore, no device has been available for conveniently converting between a cap and a sunvisor while keeping both the cap and the sunvisor pleasing in appearance.

SUMMARY OF THE INVENTION

The present invention provides a cap-sunvisor combination which may be readily converted back and forth. A visor extends from a forward portion of a headband. The forward lower edge of the crown is secured to the visor-headband connection. The rearward portion of the lower edge of the crown lies along the headband and can be moved forward while gathering the crown to form a visor. In that condition, the rearward lower edge portion is secured near the forward lower edge portion, such as by fasteners on the crown or, preferably, by a tab which extends from a medial portion of a loop secured to the rearward edge portion of the crown. The tab has a fastening means which may connect with a fastening means on the frontal portion of the band or on an upper portion of the visor near the band or on a forward portion of the crown. Alternatively, the tab is a strap which extends from inside the frontal portion of the band or crown around the rearward edge of the crown so that it may be fastened in a forward position. When used as a cap, the tab or band may be fastened to a rearward edge of the band, such as by bringing the distal end of the tab or strap under the rearward portion of the band and fastening it to an outer rearward portion of the band. When an elongated strap is used as a tab, the strap may be passed through loops sewn inside of the crown or the strap may be passed back and forth through slits in the crown. In that condition, preferably, the end of the tab is enlarged so that it does not easily pass back through the slits or loops.

In the preferred form of the invention, the band is divided at its rearward extension, and overlapping portions of the band are provided with fasteners to adjust the size of the band.

In a preferred form of the invention, the crown is made of segments which are centrally gathered at opposite sides of the cap. In a preferred form of the invention, the opposite side portions of the crown are gathered around a U-shaped element, which may be a roll of the material or a metal or plastic element. Preferably, the crown is made of segments which are stitched together. Segments may be made of the same cloth or different colored cloth.

In a preferred form of the invention, the rearward edge of the crown is reinforced with a semicircular loop which is hinged either to the U-shaped element or to the band. The semicircular loop keeps the neat appearance of the rearward edge of the crown whether the crown is compressed into a visor form or is extended rearwardly into a cap form. The loop or the rearward edge of the crown may attach to the band, preferably, to an outer surface of the band, or the rearward edge of the crown may float rearward and downward with respect to the band.

Convertible sunvisor cap comprises a band for encircling a head. The band has frontal and rear portions and has first and second opposite side portions respectively connecting the frontal and rear portions. A visor connected to the frontal portion extends forward therefrom. First and second hinge means are connected respectively to the first and second side portions of the band between the frontal and rear portions. A semicircular loop has first and second spaced ends respectively connected to the first and second hinges and has a central portion configured for overlying a rear portion of the band. Tab means has a first end connected to a central portion of the loop, and the tab means has a second end remote from the loop. A soft, flexible crown has a generally circular lower edge portion. A front semicircular portion of the lower edge of the crown is connected to the frontal portion of the band and to the visor, and a rear semicircular portion of the lower edge of the crown is connected to the loop. First fastener means is connected to an upper portion of the visor near the frontal portion of the band, and second complementary fastener means is connected to the second end of the tab means for cooperating with the first fastener means. When the loop is positioned in its rearward position, the lower edge of the crown extends around the band, forming a cap. When the loop is pivoted forward around the hinge means to a forward position with the tab means overlying a gathered portion of the crown and with the fastener on the second end of the tab means connected to the first fastener on the visor, the apparatus forms a sunvisor.

Preferably, the first and second fastening means are snap fastening means connected to an upper side of the visor and to the second end of the tab means.

In a preferred embodiment, aligned openings in first and second ends of the loop and in the respective side portions of the band receive first and second connection means extending through the respective openings for connecting ends of the loop to the sides of the band.

Preferably, the crown has gathered portions adjacent the hinges, and the gathered portions are formed around first and second U-shaped members which overlie the first and second sides of the band. Preferably, each of the U-shaped members comprise spaced forward and rearward end portions and rounded upward intermediate portions. Preferably, the forward end portions of the U-shaped members are attached to respective first and second side portions of the band.

In a preferred embodiment, the crown portion comprises multiple joined segmental portions having apexes connected to the U-shaped members.

Preferably, the rear portion of the band comprises first and second terminal portions, and means are connected to the terminal portions for selectively joining the terminal portions in size variations of the band.

The preferred sunvisor cap apparatus has band means for surrounding a head of a wearer and visor means connected to the band means over the eyes of a wearer, a soft, flexible crown for selectively covering the head of the wearer, the crown having a forward lower edge connected to a rearward portion of the visor, the crown means having a rearward lower edge portion, means for permitting the rearward lower edge portion of the crown to lie adjacent a rearward portion of the band in cap configuration and means for securing the rearward lower edge portion of the crown in a forward position when the crown is folded in a sunvisor form.

Preferably, the means for securing the rearward lower edge of the crown in a forward position comprises tab means connected to the crown and means for connecting the tab means to the hat adjacent a rearward portion of the visor means.

Preferably, the means for connecting the tab means comprises first snap means connected to a distal portion of the tab means remote from the rearward lower edge of the crown and second snap means connected to the visor means adjacent the crown.

Preferably, loop means is connected to a rearward lower edge of the crown for holding the rearward lower edge of the crown in a generally semicircular condition. Tab means has a proximal end connected to the loop means. First and second fastener means respectively are connected to an upper portion of the visor and to a distal end of the tab means for joining the tab means with an upper portion of the visor to hold the crown in forward, sunvisor configuration.

These and other and further objects and features of the invention are apparent in the disclosure, which includes the above and ongoing written specification with the claims and the drawings.

BRIEF DESCRIPTION OF THE DRAWINGS

FIG. 1 is a side elevation of a cap.

FIGS. 2 and 3 show the cap in stages of conversion to a visor.

FIG. 4 is a side elevation of a sunvisor form of the present invention.

FIG. 5 is a front view of the cap.

FIG. 6 is a back view of the cap.

FIG. 7 is a detail of a back view of the cap showing the tab and the band adjustment feature.

DETAILED DESCRIPTION OF THE DRAWINGS

Referring to the drawings, a cap, generally indicated by the numeral 2, may be converted to a sunvisor 3. The convertible cap-sunvisor 1 has a head encircling band 4 to which a visor 6 is permanently attached. A soft flexible crown 8 has a front lower edge 10 permanently attached to the connection between a frontal portion of the band 4 and a rearward portion of the crown 6. A rearward edge 12 of the crown 8 is attached to a loop 14. A tab 16 has a proximal first end 18 attached to a medial portion of the loop 12. A distal end 20 of the tab has a fastener 22 which cooperates with a fastener 24 positioned centrally on an inner portion of the visor 6 to hold the loop 14 and the rearward edge 12 of the crown 8 in a forward position in the sunvisor 3 configuration, shown in FIG. 4. The distal end 20 of the tab may be snapped to a fastener attached inside one of the segments of the crown 8. For example, in the preferred embodiment, the crown 8 is made of three segments, 26, 28 and 30. A fastener to hold the distal end of the tab 16 in its nonoperative position may be sewn centrally inside the seam 27.

In a preferred form of the invention, the loop 14 overlies the rear half of the band 4, as shown in FIGS. 1 and 6.

The rear portion of the band 4 is preferably constructed of two overlapping portions 32 and 34, which have cooperating fastening means 36 and 38 to permit size adjustment of the band. In the preferred embodiment, the band 4 is made of a flexible reinforcement material covered by cloth, and the loop 14 is of a size to overlie the largest extension of the adjustable band. The size of the segments in crown 8 permits the loop 14 to move rearward so that the loop need not be connected to the rearward portion of the band 4. Alternatively, a fastener may be provided to connect the inside of loop 14 to the outside of band 4.

As shown in FIGS. 1–4, apexes of the segments 26, 28 and 30, which form crown 8, are preferably stitched together around a U-shaped insert. The U-shaped insert may be a rolled fabric, may be the fabric of the crown segments or may be a plastic or metal insert. The U-shaped member 40 permits gathering of the ends of the segments in an attractive manner when the crown 8 is formed as a cap 2 or as a sunvisor 3.

In one form of the invention, as shown in FIG. 4, loop 14 has ends 42 with openings aligned with openings in side portions of band 4 through which a pivot pin or rivet 44 is mounted. Alternatively, as shown in FIG. 3, the pivot pins 44 may connect ends 42 of the loop 14 with a rearward end 46 of the U-shaped element 40. The front ends 48 of the U-shaped element 40 are permanently attached to the band 4.

While the invention has been described with reference to specific embodiments, modifications and variations of the invention may be constructed without departing from the scope of the invention.

The scope of the invention is defined in the following claims.

I claim:

1. Convertible sunvisor cap apparatus comprising a band for encircling a head, the band having frontal and rear portions and having first and second opposite side portions respectively connecting the frontal and rear portions, a visor connected to the frontal portion and extending forward therefrom, first and second hinge means connected respectively to the first and second side portions of the band between the frontal and rear portions, a semicircular loop having first and second spaced ends respectively connected to the first and second hinges and having a central portion configured for overlying a rear portion of the band, tab means having a first end connected to a central portion of the loop means, and the tab means having a second end remote from the loop means, a soft flexible crown having a generally circular lower edge portion, a front semicircular portion of the lower edge of the crown being connected to the frontal portion of the band and to the visor and a rear semicircular portion of the lower edge of the crown being connected to the loop means, first fastener means connected to an upper portion of the visor near the frontal portion of the band, and second complementary fastener means connected to the second end of the tab means for cooperating with the first fastener portion, whereby, when the loop means is positioned in its rearward position, the lower edge of the crown extends around the band, forming a cap and wherein, when the loop means is pivoted forward around the hinge means to a forward position with the tab means overlying a gathered portion of the crown and with the fastener on the second end of the tab means connected to the first fastener on the visor, the apparatus forms a visor.

2. The apparatus of claim 1 wherein the first and second fastening means comprise snap fastening means connected to an upper side of the visor and to the second end of the tab means.

3. The apparatus of claim 1 wherein the hinge means comprises aligned openings in first and second ends of the loop means and in the respective side portions of the band and further comprising first and second connection means extending through the respective openings for connecting ends of the loop means to the sides of the bands.

4. The apparatus of claim 1 wherein the crown means comprises gathered portions adjacent the hinge portions and wherein the gathered portions are formed around first and second U-shaped members overlying the first and second opposite side portions of the band.

5. The apparatus of claim 4 wherein each of the U-shaped members comprise spaced forward and rearward end portions and bounded upward intermediate portions.

6. The apparatus of claim 5 wherein the forward end portions of the U-shaped members are attached to respective first and second side portions of the bands.

7. The apparatus of claim 5 wherein the crown portion comprises multiple joined segmental portions, each having apexes connected to the U-shaped members.

8. The apparatus of claim 1 wherein the rear portion of the band comprises first and second terminal portions and means connected to the terminal portions for selectively joining the terminal portions in size variations of the band.

9. Convertible sunvisor cap apparatus comprising band means for surrounding a head of a wearer and visor means connected to the band means for extending forward from the band means over the eyes of a wearer, a soft flexible crown means for selectively covering the head of the wearer, the crown means having a forward lower edge, means for connecting the forward lower edge of the crown means adjacent a rearward portion of the visor, the crown means having a rearward lower edge portion, means for permitting the rearward lower edge portion of the crown to lie adjacent a rearward portion of the band in cap configuration and means for securing the rearward lower edge portion of the crown in a forward position when the crown is folded in a sunvisor form.

10. The apparatus of claim 9 wherein the means for securing the rearward lower edge of the crown in a forward position comprises tab means connected to the crown and means for connecting the tab means to the hat adjacent a rearward portion of the visor means.

11. The apparatus of claim 10 wherein the means for connecting the tab means comprises first snap means connected to a distal portion of the tab means remote from the rearward lower edge of the crown and second snap means connected to the visor means adjacent the crown.

12. The apparatus of claim 9 further comprising loop means connected to a rearward lower edge of the crown for holding the rearward lower edge of the crown in a generally semicircular condition.

13. The apparatus of claim 12 further comprising tab means having a proximal end connected to the loop means and having a distal end and first and second fastener means respectively connected to an upper portion of the visor and to the distal end of the tab means for joining the tab means with an upper portion of the visor to hold the crown in forward, sunvisor configuration.

* * * * *